US005846927A

United States Patent [19]

Vasudevan

[11] Patent Number: 5,846,927

[45] Date of Patent: Dec. 8, 1998

[54] MATRIX OR CORE SHELL ENZYME CAPSULE COMPOSITIONS COMPRISING DEFINED DENSITY MODIFYING SOLIDS SURROUNDED BY DEFINED CORE STRUCTURANT MATERIAL

[75] Inventor: Tirucherai Varahan Vasudevan, West Orange, N.J.

[73] Assignee: Lever Brothers Company, Division of Conopco, Inc., New York, N.Y.

[21] Appl. No.: 629,416

[22] Filed: Apr. 8, 1996

[51] Int. Cl.[6] ..... C11D 3/37; C11D 17/08

[52] U.S. Cl. ..... 510/530; 510/304; 510/340; 510/372; 510/441

[58] Field of Search ..... 510/304, 340, 510/272, 530, 441; 435/188, 182, 264, 281

[56] References Cited

U.S. PATENT DOCUMENTS

| | | | |
|---|---|---|---|
| 4,090,973 | 5/1978 | Maguire et al. . | |
| 4,759,956 | 7/1988 | Amer et al. | 510/530 |
| 4,777,089 | 10/1988 | Tokizawa et al. | 510/530 |
| 4,801,544 | 1/1989 | Munk . | |
| 4,906,396 | 3/1990 | Falholt et al. . | |
| 4,908,233 | 3/1990 | Takizawa et al. | 510/530 |
| 5,281,356 | 1/1994 | Tsaur et al. | 510/530 |
| 5,324,445 | 6/1994 | Langley et al. . | |
| 5,434,069 | 7/1995 | Tsaur et al. . | |
| 5,441,660 | 8/1995 | Tsaur et al. . | |
| 5,460,817 | 10/1995 | Langley et al. | 510/530 |

*Primary Examiner*—Margaret Medley
*Attorney, Agent, or Firm*—Ronald A. Koatz

[57] ABSTRACT

The present invention relates to improved matrix or core shell enzyme capsule compositions comprising certain density modifying solids and defined core structural ingredients. Using these capsule compositions, much better active stability is obtained. In addition, higher active retention is accomplished during capsule formation. Release characteristics are not compromised. In a second embodiment of the invention, the invention relates to structured heavy duty liquid compositions comprising these capsules.

8 Claims, No Drawings

MATRIX OR CORE SHELL ENZYME CAPSULE COMPOSITIONS COMPRISING DEFINED DENSITY MODIFYING SOLIDS SURROUNDED BY DEFINED CORE STRUCTURANT MATERIAL

BACKGROUND OF THE INVENTION

1. Field of the Invention

The present invention relates to matrix or core shell enzyme capsules used to protect sensitive ingredients (e.g., enzymes, peracid bleaches, bleach catalysts) in liquid detergent compositions. The invention further relates to compositions containing the matrix or core shell capsules.

2. Background

It is well known in the art that liquid detergents may provide a hostile environment to sensitive ingredients (e.g., enzymes, peracid bleaches, bleach catalysts and/or perfumes) used in these detergents.

In order to protect sensitive ingredients, one method used in the art has been encapsulation.

The encapsulation of sensitive ingredients, especially detergent enzymes, has been in practice for a number of years. Techniques range from encapsulating the enzymes in a reverse micelle (U.S. Pat. No. 4,801,544 to Munk) to protecting them in a hydrocarbon fluid such as silicone oil and petroleum jelly (U.S. Pat. No. 4,906,396 to Falholt et al.); in a solid surfactant (U.S. Pat. No. 4,090,973 to Maguire et al.) or in a polymer matrix (U.S. Pat. No. 5,324,445 to Langley et al.). In many of the prior inventions, the enzyme is used either as an aqueous solution or as a finely dispersed colloidal size solid (about 1 $\mu$m and less). In the invention where larger enzyme particles were used (U.S. Pat. No. 4,906,396 to Falholt), i.e., 1 $\mu$m to 2 mm, the particles were dispersed in a hydrophobic core and the core was directly incorporated (dispersed) into the detergent formulation, not into a polymer matrix, as carried out in the present invention. However, the polymer matrix has been found to be necessary to achieve the desired enzyme stability in liquid detergent systems containing bleach particles.

U.S. Pat. No. 4,906,396 to Falholt et al. teach encapsulation of enzyme particles ranging from 1 $\mu$m to 2 mm in size in a hydrocarbon core material such as silicone oil or petroleum jelly. Falholt et al. fail to teach a polymer shell surrounding the hydrocarbon core. Such a shell is required to boost stability of enzyme in bleach containing liquid.

Although U.S. Pat. No. 5,324,445 to Langley et al. teach both a hydrocarbon core and a polymer shell, that patent is concerned with encapsulating enzyme particles in the colloidal size range, i.e., about 1 $\mu$m (micron). Since there is only a teaching of solids in the colloidal size range, there is no teaching, recognition or suggestion that core material used for encapsulating larger solids (i.e, greater than 1 micron, preferably greater than 5 microns) needs to have appropriate Theological properties to maintain desired enzyme yield and stability (i.e., particularly during preparation of capsule where, without proper core rheology, enzyme loss from core can reach 25% to 100%). It should also be noted that hydrocarbon cores of Langley are generally less than 20 microns and usually below 10 microns whereas those of the subject application are, on average, over 100 microns. It should further be noted that phase separation due to gravity is not a problem in the smaller cores of the Langley et al. reference. Finally, the size of Langley capsules was 20 microns and less whereas less than 1% of capsules of subject invention are less than 20 microns.

U.S. Pat. Nos. 5,434,069 and 5,441,660 both to Tsaur et al., both teach core components of a matrix or core-shell capsule wherein the core comprises hydrophobic oils that are semi-solid or liquids and which contain hydrophobic structuring particle less than 3 microns.

Again, there is no teaching or recognition that proper modification of the core chemistry (i.e., selection of specific core materials and inclusion of specific density modifying solids) can result in much larger improvements in enzyme stability, as well as yield (100 - loss), during emulsification while maintaining the extent of enzyme release during wash.

BRIEF DESCRIPTION OF THE INVENTION

Unexpectedly, applicants have found that matrix or core shell capsule compositions (single core coated with cross-linking polymer is generally referred to a "core-shell" while a plurality of cores dispersed in a cross-linking polymer gel are referred to as "matrix" capsules) wherein the hydrocarbon core or cores have been modified to (1) include specific density modifying solids and (2) contain specific core ingredients, such capsule compositions can maintain such greater stability that:

(a) sensitive components are not readily lost during capsule preparation (e.g., less than 30% loss);

(b) much larger size sensitive components than used in the prior art can be protected (e.g., phase separation due to gravity is no longer a problem); and (3) rapid release of components in wash is still obtained.

Specifically, the present invention comprises a matrix or core shell capsule composition comprising:

(1) a component normally subject to degradation by ingredients outside the capsule in the detergent composition;

(2) a density modifying solid having a size of 5 to 100 microns.

(3) a hydrophobic polymeric core surrounding both the component (1) and component (2) wherein said core comprises a hydrophobic polymer, preferably an ethylene-propylene (E-P) block copolymer, with an average molecular weight of 100 to 600, has average number of branches per molecule of 1 to 2, and has a melting point of 40° to 85° C.; and oil, preferably mineral oil, wherein the oil has a viscosity in the range of 10 to 100 centipoise and a specific gravity in the range 0.7 to 1.2; the ratio of hydrophobic polymer to oil being 0.2 to 2.0 weight by weight;

(4) a core diluent having a viscosity such that when mixed with solids (1), (2) and (3) at less than 60% of final capsule composition, the viscosity of core components (1) to (3) and the diluent (4) combined is less than 10,000 mPas measured at a shear rate of $100s^{-1}$ and above; and (5) a polymeric matrix or shell surrounding a mixture of said (1), (2) & (3) and diluent (4) wherein said shell is a water soluble polymer or water dispersible polymer selected from the group consisting of polyvinyl alcohol, a polyvinylamide, polyvinyl pyrrolidone, carrageenan, guar gum, xanthan gum, cellulose and protein.

DETAILED DESCRIPTION OF THE INVENTION

The present invention relates to matrix or core shell enzyme capsule compositions which are used in liquid detergent compositions to protect sensitive components present in the capsule compositions from degradation or attack by harsher components also present in the detergent compositions.

When it is a single core component with the polymeric matrix surrounding the one large core, this is generally referred to as a core-shell capsule, while a plurality of cores surrounded by the polymeric matrix medium is generally referred to as a matrix capsule.

The capsule compositions of the invention (whether core-shell or matrix) generally comprise a hydrophobic polymeric core surrounding the sensitive component dispersed in a polymer matrix surrounding a mixture of said core and diluent. As noted, if there is only one core per matrix, this would be more commonly referred to as a "core-shell" composition.

Matrix capsules of the type described in the present invention have been used in the art (i.e., U.S. Pat. Nos. 5,434,069 and 5,441,660 both to Tsaur et al., both of which are hereby incorporated by reference into the subject application). Although the prior art capsules increased the stability of sensitive component in a harsh environment such as a heavy duty detergent liquid containing a peracid bleach, the stability was still relatively poor.

Unexpectedly, applicants have found that the stability of the sensitive ingredient can be drastically improved over that of the prior art capsules by:

(1) using specific defined hydrophobic ingredients that make up the core (i.e., defined hydrophobic polymers in combination with defined oils); and (2) adding a density modifying solid with the sensitive component wherein both the sensitive ingredient and the defined density modifying solid are enveloped by the core.

The core is also mixed with a core diluent of defined characteristics.

With these modifications, chemical stability and enzyme yield of the sensitive ingredient is remarkably enhanced and the enzyme yield and release characteristics of the capsule are not compromised.

The various components of the capsule composition are described in greater detail below.

Active

The active component of the capsule can be any material which would have significant reduction or complete loss of activity in a cleaning product (especially a bleach-containing liquid) if it were not encapsulated.

The active material protected by the core may be a hydrophilic active (e.g., enzyme or bleach catalyst) or a hydrophobic active (e.g., perfume) and can be solid, liquid or in aqueous solution. The benefits of the invention are more readily apparent when the active is a hydrophilic one. Hydrophilic active materials include enzymes, bleach catalysts, peracid bleaches, bleach activators and optical brighteners.

Such enzymes, peroxygen activators, peracid bleaches, bleach catalysts can be any of these recited, for example, in U.S. Pat. No. 5,434,069 and U.S. Pat. No. 5,441,660 to Tsaur et al., both of which references are hereby incorporated by reference. Active comprises 0.1% to 25% by wt. of the capsule composition, preferably 1% to 15%.

Density Modifying Solid

The density modifying solid which is used in these capsules is preferably chemically non-reactive towards the detergent components (e.g., bleach) which deactivate the sensitive ingredient (e.g., enzyme) in the capsule; and has a particle size of from greater than 5 to about 100 microns.

Examples of chemically non-reactive solids include mineral-type solids such as alumina, calcite and quartz; and water-soluble solids such as salts formed by the reaction between an acid and a base (e.g., sodium sulfate, sodium chloride etc.)

Both the sensitive ingredient and the density modifying solids are enveloped by the hydrophobic core polymer (e.g., E-P block copolymer).

In one embodiment of the invention, it has been found that by treating the density modifying solid with surfactant (surfactant treatment is generally done by stirring the solids with aqueous surfactant solution for 5 minutes to 24 hours at 25° to 80° C. and then filtering and drying solids), even further protection of sensitive ingredient (e.g., enhanced enzyme stability) can be obtained. An example of aqueous surfactant which can be used to treat the solid is 0.1 M alkali metal $C_{12}$–$C_{24}$ sulfate (e.g., sodium lauryl sulfate). Generally, treatment can be at 0.01 to 10 molar (M) solution, preferably 0.1 to 1 M.

Generally, anionic surfactants are used with positively charged solids such as alumina and calcite and cationic surfactants are used on negatively charged solids such as quartz. In general, any surfactant which can adsorb on the solid and render it's surface hydrophobic can be used. Anionic surfactants can be any of the anionic noted in M. Rosen, Surfactants and Interfacial Phenomena, Second Edition, John Wiley and Sons, 1989, Chapter 2, hereby incorporated by reference; and the cationics can be any cationic noted in the same reference to M. Rosen noted above.

Generally, solids comprise 0.1 to 30% by wt., preferably 1 to 20% by wt. of the capsule composition.

Hydrophobic Core Material

The hydrophobic core of the invention can be any hydrophobic polymer that has a melting point of 40° to 85° C. in combination with any oil having a viscosity in the range of 10 to 100 centipoise and a specific gravity in the range of 0.7 to 1.2.

A preferred hydrophobic core material is an E-P block copolymer having an average molecular weight of 100 to 600 and average of 1 to 2 branches per molecule in combination with mineral oil. The ratio of polymer to mineral oil should be from 0.2 to 2.0 weight by weight. In general the core should comprise about 10% to 80% of the capsule composition.

Hydrophobic Core Diluent

Hydrophobic core diluent can be any structured hydrocarbon oil (e.g., wax crystals dispersed in hydrocarbon oil) such as Tro-grees (supplied by Penreco) which lowers the viscosity of the core so that mixing of the core with the matrix polymer solution can be accomplished using a mixing device such as a flotation machine. The viscosity of the structured core diluent should be such that when mixed with the organic core containing solids in an amount less than 60 weight percent of the capsule, preferably less than 30 weight percent of the capsule, the viscosity of the organic core-core diluent mixture is less than 10,000 mPas, preferably less than 5,000 mPas and most preferably less than 2,000 mPas at a shear rate of $100s^{-1}$ and above.

Matrix or Core Shell Polymer

A mixture of the hydrophobic core and the core diluent is dispersed in a polymer matrix. As discussed, if it is one core only, this is a core-shell capsule and, if a plurality of cores are in the matrix, this is considered a matrix capsule.

Polymers suitable for forming the matrix of this invention must be insoluble in the composition of the liquid cleaning product and must disintegrate or dissolve during the use of the product simply by dilution with water, pH change or mechanical forces such as agitation or abrasion. The preferred polymers are water soluble or water dispersible polymers that are or can be made insoluble in the liquid detergent composition. Such polymers are described in EP 1,390,503; U.S. Pat. No. 4,777,089; U.S. Pat. No. 4,898,781; U.S. Pat. No. 4,908,233; U.S. Pat. No. 5,064,650, U.S. Pat. No. 5,385,959 to Tsaur et al., all of which are incorporated by reference into the subject application.

These water soluble polymers display an upper consolute temperature or cloud point. As is well known in the art (P. Molyneaux, Water Soluble Polymers CRC Press, Boca Raton, 1984), the solubility or cloud point of such polymers is sensitive to electrolyte and can be "salted out" by the appropriate type and level of electrolyte. Such polymers can generally be efficiently salted out by realistic levels of electrolyte (<10%). Suitable polymers in this class are synthetic nonionic water soluble polymers including: polyvinyl alcohol; polyvinyl pyrrolidone and its various copolymers with styrene and vinyl acetate; and polyacrylamide and its various modification such as those discussed by Molyneaux (see above) and McCormick (in Encyclopedia of Polymer Science Vol. 17, John Wiley, New York). Another class of useful polymers are modified polysaccharides such as carrageenan, guar gum, pectin, xanthan gum, partially hydrolyzed cellulose acetate, hydroxy ethyl, hydroxy propyl and hydroxybutyl cellulose, methyl cellulose and the like. Proteins and modified proteins such as gelatin are still another class of polymers useful in the present invention especially when selected to have an isoelectric pH close to that of the liquid composition in which the polymers are to be employed.

From the discussion above, it is clear that a variety of hydrophilic polymers have potential utility as the polymer coating for the capsules of this invention. The key is to select an appropriate hydrophilic polymer that would be essentially insoluble in the composition (preferably a concentrated liquid system) under the prevailing electrolyte concentration, yet would dissolve or disintegrate when this composition is under conditions of use. The tailoring of such polar polymers is well within the scope of those skilled in the art once the general requirements are known and the principle set forth.

The matrix polymer generally will comprise 0.1 to 50% by wt., preferably 1% to 10% of the total capsule composition.

Capsule

The capsule of this invention can be produced by a variety of known encapsulation processes. For example, the capsule can be prepared according to the coacervation process in which the hydrophobic core containing the active is dispersed in an aqueous solution of a water soluble or water dispersible polymer. In this procedure, a non-solvent for the polymer or an electrolyte is added or a pH change or a pressure change is effected to make the capsule. Examples of this coacervation process are described in U.S. Pat. No. 4,777,089, U.S. Pat. No. 3,943,063 and U.S. Pat. No. 4,978,483, all three of which are incorporated herein by reference. Similarly, the capsule can be formed by adding an emulsion of the hydrophobic core containing the active in polymer solution to the non-solvent. In this process, the hydrophobic core composition and the emulsification process are critical because the active must stay within the core rather than diffuse out during the emulsification from the hydrophobic core to the polymer solution. Higher ratio of hydrophobic polymer to mineral oil is especially useful to help the retention of actives in the hydrophobic core during emulsification. The amount of hydrophobic polymer in the core is greater than 0.5%, preferably greater than 5% and most preferably greater than 15% by wt. of the total hydrophobic core. The emulsification process should be carried out under low shear (less than 5000 $s^{-1}$) to prevent release of the active from the hydrophobic core to the polymer solution and to ensure the resulting hydrophobic core size is larger than the particle size of the active.

The capsule of the invention also can be prepared by extrusion nozzles as taught in U.S. Pat. No. 3,310,612, U.S. Pat. No. 3,389,194 or U.S. Pat. No. 2,799,897 and GB 1,390,503. In these processes, the hydrophobic core is extruded through the inert orifice of the nozzle. Simultaneously, the water soluble polymer solution is extruded through the outer orifice of the nozzle to form a uniform coating on the surface of hydrophobic core containing the active. The capsule is then formed by breaking the coextrudate at the end of the nozzle orifice by air, centrifuge force, blade or carry fluid to form droplets which are hardened in a non-solvent of the water soluble polymer to form the capsule.

Compositions

In another embodiment of the invention, the invention relates to the use of the novel capsule compositions in aqueous detergent compositions. Preferably, the compositions are bleach containing aqueous detergent compositions. In fact, it is in those bleach containing aqueous detergent compositions that the benefits of the invention became readily apparent since it has previously been extremely difficult, if not impossible, to formulate capsules for use in bleach containing aqueous compositions wherein the actives are well protected in the capsule, yet readily release upon dilution.

The aqueous detergent compositions of the invention are typically structured (duotropic) or unstructured (isotropic) detergent compositions such as described in U.S. Pat. No. 5,089,163 to Aronson et al. or 4,908,150 to Hessel et al. (for isotropic liquids) or U.S. Pat. No. 4,992,194 to Liberati et al. or U.S. Pat. No. 5,147,576 to Montague et al. (for structured liquids) all of which are incorporated by reference into the subject application.

Such compositions will generally comprise water, surfactants, electrolyte (for structuring and/or building purposes) and other ingredients such as are described below.

The surfactants may be anionic, nonionic, cationic, zwitterionic, or soap or mixtures thereof such as those described, for example, in U.S. Pat. No. 4,642,198 at columns 3 to 4.

The total surfactant amount in the liquid composition of the invention may vary from 2 to 80% by weight, preferably from 10 to 50% by weight, depending on the purpose of use. In the case of suspending liquids comprising an anionic and a nonionic surfactant the ratio thereof may vary from about 10:1 to 1:10. The term anionic surfactant used in this context includes the alkali metal soaps of synthetic or natural long-chain fatty acids having normally from 12 to 20 carbon atoms in the chain.

The total level of electrolyte(s) present in the composition to provide structuring may vary from about 1.5 to about 30%, preferably from 2.5 to 25% by weight.

The capsule compositions of the invention will generally comprise 0.01 to 2% by wt., preferably 0.1 to 15% of the detergent composition.

In addition to the components discussed above, the heavy duty liquid detergent compositions of the invention may also contain certain optional ingredients in minor amounts. Typical examples of optional ingredients are suds-controlling agents, fluorescers, perfumes, coloring agents, abrasives, hydrotropes, sequestering agents, enzymes, and the like in varying amount.

Bleaches used in the invention may be any of those described in U.S. Pat. No. 4,992,194 to Liberati, hereby incorporated by reference. Peroxygen salts include salts such as sodium perborate tetrahydrate or monohydrate, percarbonate, persilicate, persulfate, dipersulfate and the like. Other peroxygen compounds include perphosphates, peroxide and perpolyphosphates. As indicated above, the peroxygen salts may be activated by activators which may be encapsulated actives.

The decoupling polymer is also as disclosed in U.S. Pat. No. 4,992,194 to Liberati. The bleaches may also be, but are not limited to, any of the peracid bleaches described in the "actives" section (i.e., the mono- or di- percarboxylic amido or imido acids) or the amido peroxy acids disclosed in U.S. Pat. Nos. 4,409,953 and 5,055,210, hereby incorporated by reference into the subject application.

In a preferred embodiment of the invention, the composition is a peracid bleach containing composition and the capsule of the invention (first embodiment) protects the active (e.g., enzyme or bleach catalyst) from the action of the peracid bleach (and other harsh components) in the liquid compositions. In this embodiment of the invention, the peracid bleach may be any of the peracid bleaches described above and are preferably amides selected from amido peracids such as Terephthaloyl-di-(6-aminopercarboxycaproic acid) (TPCAP); N,N'-Di(4-percarboxybenzoyl)piperazine (PCBPIP); N,N'-Di(4-percarboxybenzoyl)ethylenediamine (PCBED) and any of the other above recited amides peracids. When used in the composition, the peracid will comprise 0.1% to 50% by weight, preferably 0.5% to 25% by weight, more preferably 1 to 10% by weight of the composition.

Unless stated otherwise, all percentages are intended to be percentages by wt.

The following examples are intended to further illustrate and describe the invention and are not intended to limit the invention in any way.

EXAMPLES

MATERIALS AND METHODS

Materials

Hydrocarbon oils: Petrolatum (petroleum wax), Tro-Grees (mixture of Petrolatum and hydrocarbon oil) and mineral oil (Parol 70) were purchased from Penreco.

Polymers: Hydrophilic polymers Acrysol ASE 60 (latex) and polyvinyl alcohol (PVA) (Airvol 540) were supplied by Rohm and Haas and Air Products respectively. Hydrophobic polymer used as a core component is an ethylene-propylene (E-P) block copolymer of an average molecular weight of 500 Daltons and one branch per molecule, supplied by Petrolite Corporation.

Enzyme: Optimase enzyme powders used in the study was supplied by Solvay.

Density modifying solids: Alumina, 5 to 10 $\mu$m in size, was purchased from Aldrich. Calcite was purchased from Wards Scientific, while sodium sulfate and sodium sulfite were purchased from Fisher Scientific. These samples (except alumina) were ground to a fine powder using an agate mortar and pestle. A microscopic analysis of these powders showed calcite to be 5 to 10 $\mu$m in size and sodium sulfate and sodium sulfite to be 5 to 40 $\mu$m in size.

Other Reagents: Sodium hydroxide used for neutralizing acrylate polymer was of reagent grade, supplied by Fisher Scientific Company. Milli Q water was used in all the experiments.

Methods

Preparation of Polymer (PVA-Acrysol ASE 60) Solutions 3.33 parts of poly vinylalcohol (PVA) were weighed into a beaker and 60.7 parts of Milli Q water were added to it. The temperature of the contents was raised to about 65° C., while stirring the slurry using a stainless steel impeller. Stirring was continued at about 65° C. until all the PVA dissolved, following which 5.95 parts of Acrysol ASE 60 were added. Stirring was continued for 5 minutes after which the solution was allowed to stand for degassing. After degassing, 30 parts of a 2 weight percent sodium hydroxide solution was added over a 30 minute period, while keeping the solution gently stirred using a propeller type impeller. During the entire process of making the polymer solution extreme care was taken to avoid entrapment of air bubbles.

Preparation of Hydrocarbon Slurries

A known amount of Petrolatum was first heated to 60°–65° C. When a mixture of hydrophobic polymer, mineral oil and density modifying solids in specific proportions was used as a Petrolatum substitute, the mixture was heated to 90°–95° C. The enzyme powder was dispersed into the molten mixture under intense agitation. The slurry was then cooled using an ice-bath to 20°–25° C. in about 5 to 10 minutes. A known amount of Tro-Grees was then blended with the enzyme slurry by mildly mixing the contents by hand using a spatula. Tro-grees is a diluent that decreases the viscosity of the organic slurry to an extent that enables emulsification using commercially available equipment feasible. The composition of the hydrophobic core is shown in Table 1.

Preparation of Emulsions 30 to 40 grams of the hydrocarbon slurry (disperse phase) and 360–370 grams of the (hydrophilic) polymer solution (continuous phase) were weighed into a beaker. The contents were hand stirred slowly using a plastic spatula for premixing the two phases. During this stage care was taken to avoid formation of fine droplets. The premixed contents were then fed into the cell of a flotation machine and sheared for two minutes. A 25 gram sample of the emulsion was diluted with 200 grams of water to destabilize the emulsion. The aqueous phase was then analyzed for enzyme content so as to determine the loss of enzyme during emulsification. Rest of the emulsion was sprayed to obtain capsules. Details of the flotation machine are described in Society of Mineral Engineers Handbook (N. L. Weiss Ed., Section 5, pages 82–109).

Preparation of Capsules by Spraying of Emulsions

A known amount of the emulsion sample was loaded into a stainless steel syringe pump connected to a two-fluid spray nozzle (Nozzle diameter=1,500 $\mu$m; Spraying Systems Inc.). The outer port of the nozzle was connected to an air outlet. The air valve was opened first and the pressure adjusted to the desired value. The liquid was then introduced into the nozzle and the spray was collected in a 3-ft diameter bath filled with the hardening solution (15 wt % $Na_2SO_4$, 1.5 wt. % borax and 0.001 wt. % SDS in Milli Q water). During collection of the spray hardening solution was kept mildly stirred in order to minimize agglomeration of the hardening capsules. Hardened capsules were removed from the bath using a stainless steel sieve and washed (using the hardening solution) into a plastic bottle and sorted for further studies.

A typical composition of the hydrophobic core is shown in Table 1 below:

TABLE 1

Composition of the Hydrophobic Core

| Component | Wt. % | Remarks |
|---|---|---|
| E-P Block Copolymer | 18.0–26.0 | Core structurant* |
| Mineral oil | 20.0–28.0 | |
| Tro-Grees | 28.0 | core diluent |
| Density modifying solid | 10.0 | |
| Optimase (enzyme) | 10.0 | |

*In comparative tests E-P block copolymer core structurant was replaced with petrolatum.

The capsules are incorporated in liquid detergent formula having the composition shown below.

| Component | Wt. % |
|---|---|
| LAS acid (alkyl benzene sulfonic acid) | 22.7 |
| Ethoxylated alcohol | 10.4 |
| Sodium citrate 2 aq. | 8.2 |
| Sodium borate 10 aq. | 3.2 |
| Sorbitol (active) | 9.6 |
| Decoupling polymer (active)* | 1.5 |
| Ethylenediamine tetraacetate | 0.9 |
| Peracid bleach (active)** | 4.2 |
| Fluorescer | 0.2 |
| Deionized water | to 100 |

*Hydrophobically modified polyacrylic acid aqueous solution having MW of about 3800 Similar polymers are taught in U.S. Pat. No. 5,147,576 to Montague et al. which is hereby incorporated by reference into the subject application.
**TPCAP

Example 1

Effect of different density modifying solids on storage stability of enzyme capsules in heavy duty prototype liquid containing peracid bleach.

| Density Modifying Solid | App. Particle Size Microns | ($t_{1/2}$) Half life in days at 37° C.* |
|---|---|---|
| Alumina | 5–10 | 19 |
| Calcite | 5–10 | 29 |
| Quartz | 10–100 | 11 |
| Sodium Sulfate | 10–40 | 12 |
| Sodium Sulfite | 5–40 | 2.5 |
| Cab-bo-sil | <3 | Organic core extremely viscous; emulsin preparation is not possible |
| None | | Emulsion unstable |

*t ½: half life is defined as number of days under storage conditions at which the residual enzyme activity in the capsule reaches 50% of the initial activity. The higher the t ½ value, the more stable is the enzyme.

This example shows that both mineral type solids such as alumina, quartz and calcite as well as water soluble salts formed by the reaction between an acid and a base (such as sodium sulfate) which do not chemically react with bleach provide good stability. However, water soluble salt sodium sulfite (which does chemically react with bleach) does not provide much stability. Furthermore, very small (<3 microns) hydrophobic solids cannot be incorporated as the organic core becomes extremely viscous at levels (~10 weight percent) needed to closely match density of the organic core and the polymer solution.

Example 2

Effect of treating the density modifying solid with surfactant (0.1 M sodium lauryl sulfate or 0.1 M dodecyl amine) on storage stability of enzyme capsules in heavy duty prototype liquid containing peracid bleach.

| Density Modifying Solid | Surfactant Treatment | $t_{1/2}$(days at 37° C.) |
|---|---|---|
| Alumina | No | 19 |
| | Yes | 49 |
| Quartz | No | 11 |
| | Yes | 14 |

This example shows that even further enhanced stability can be obtained by treating the solid with surfactant. Alumina (a positively charged solid) was treated with negatively charged (anionic) surfactant (0.1 M sodium dodecyl sulfate); while quartz (negatively charged solid) was treated with positively charged (cationic) surfactant (0.1 M dodecyl amine).

Example 3

Effect of EO-PO copolymer to mineral oil ratio of the organic core on enzyme loss during emulsification; and on storage stability of enzyme capsules in heavy duty prototype liquid containing peracid bleach.

| EO-PO Polymer: Mineral oil (wt/wt) | $t_{1/2}$(days at 37° C.) | Enzyme loss during emulsification (%) |
|---|---|---|
| 0.67 | 49 | 28 |
| 0.8 | 39 | — |
| 1.2 | 41 | 2.6 |

Note: Density modifying solid was alumina treated with 0.1M sodium dodecyl sulfate.

This example shows that increasing the E-P block copolymer content of the core, in relation to mineral oil, provides somewhat lower stability, but lower enzyme loss (which means higher yield). Yield is defined as 100%- enzyme loss; thus for example, yield at 1.2 ratio is 100-2.6 or 97.4%.

Example 4 (Comparative)

Effect of organic core structurant material on storage stability of enzyme capsules in heavy duty prototype liquid containing peracid bleach.

| Organic Core Structurant | Density Modifying Solid | $t_{1/2}$ (days at 37° C.) | % enzyme loss during emulsification |
|---|---|---|---|
| Petrolatum | None | 8.0 | — |
| Petrolatum | Alumina | 10.0 | 25.0 |
| EO-PO Copolymer + Mineral Oil (0.67 wt/wt.) | None | Not stable | |
| EO-PO copolymer + mineral oil (0.67 wt/wt.) | Alumina | 49.0 | 28.0 |
| EO-PO copolymer + mineral oil (1.2 wt/wt) | Alumina | 41.0 | 2.6 |

Note: Density modifying solid is alumina treated with 0.1M sodium dodecyl sulfate.

This example shows that hydrophobic polymer-mineral oil cores of the present invention are much superior to hydrocarbon oil (petrolatum) cores of Tsaur et al., both in terms of enzyme loss during emulsification as well as stability in a bleach containing liquid. It should be noted that while at 0.67 wt./wt. ratio, enzyme loss is about the same (although stability is greatly enhanced), at ratio of 1.2, both enzyme loss and stability are greatly enhanced.

Example 5

Tergo-to-meter tests on AS 10 (protease enzyme sensitive cloth) test cloth (2 pieces per pot)

Washing time=15 min.

Heavy duty liquid dosage=1.2 g/liter of hardness solution

Hardness solution=120 ppm $CaCo_3$+$MgCO_3$ with $CaCo_3$/$MgCO_3$ 2:1

Optimase enzyme activity=24,000 GU/pot

| | Detergency, relative reflectance unit | | |
|---|---|---|---|
| Temp °C. | Detergent w/o enzyme | Detergent + Unencapsulated enzyme | Detergent + Encapsulated Enzyme |
| 20 | 4.0 | 6.9 | 6.5 |
| 30 | 4.1 | 9.1 | 9.0 |
| 40 | 4.2 | 12.4 | 11.4 |

This example shows that adding enzyme to the base detergent provides better cleaning (higher reflectance unit), but there is no significant difference whether the enzyme is added in the form of capsules or in unencapsulated form indicating that encapsulation does not interfere with performance/release during washing. The capsules used in these tests were made using E-P block copolymer mineral oil mixture containing surfactant treated alumina as the hydrophobic core. The composition of the base detergent used is shown in Table 2 (no bleach was used in the detergent composition used in Tergo-to-meter tests).

I claim:

1. A matrix or core-shell capsule composition comprising:

(a) 0.1–25% of a component subject to degradation by components in an aqueous liquid composition, wherein said component subject to degradation is selected from the group consisting of enzymes, bleach catalysts, peracid bleaches, bleach activators and optical brighteners;

(b) 0.1–30% by wt. of a mineral-type solid or water soluble salt solid that are chemically non-reactive with other detergent components and have a particle size of 5 $\mu$m to 100 $\mu$m;

(c) 1.0–80% of a hydrophobic polymer core encompassing components (a) and (b) comprising hydrophobic polymer having melting temperature of 40°–85° C. in combination with an oil having a viscosity of 10–100 centipoise and specific gravity of 0.7–1.2, wherein the ratio of polymer to oil is 0.2 to 2.0;

(d) a core diluent comprising a hydrocarbon oil having a viscosity such that when mixed with components (a), (b) and (c) at less than 60% of final capsule composition, the viscosity of (a)–(d) combined is less than 10,000 mPas measured at a shear rate of $100s^{-1}$ and above; and (e) 0.1 to 50% a polymer shell surrounding a mixture of said core (c) and diluent (d) wherein said shell is a water soluble or water dispersible polymer selected from the group consisting of polyvinyl alcohol, a polyvinylamide, polyvinyl pyrrolidone, carrageenan, guar gum, xanthan gum, cellulose and protein.

2. A composition according to claim 1, wherein the chemically non-reactive, mineral-type solid is selected from the group consisting of alumina, calcite, quartz and mixtures thereof.

3. A composition according to claim 1, wherein the water soluble salt solid is formed by the reaction between an acid and a base.

4. A composition according to claim 1, wherein the solid is treated with aqueous surfactant solution for 5 minutes to 24 hours at 25° C. to 80° C., filtered and dried prior to being used in the capsule composition.

5. A composition according to claim 1, wherein the hydrophobic core comprises an ethylene-propylene block copolymer having average molecular weight of 100 to 600 and an average of 1–2 branches per molecule in combination with mineral oil.

6. A detergent composition comprising:

(a) 2% to 80% by wt. of a surfactant selected from the group consisting of anionic surfactant, nonionic surfactant, cationic surfactant, zwitterionic surfactant, soap and mixtures thereof; and (b) 0.1% to 20% of a capsule according to claim 1.

7. A composition according to claim 6, additionally comprising 1% to 30% by wt. electrolyte.

8. A composition according to claim 6, additionally comprising 0.1 to 50% peracid.

* * * * *